US009188892B2

(12) United States Patent
Shibata et al.

(10) Patent No.: US 9,188,892 B2
(45) Date of Patent: Nov. 17, 2015

(54) ELECTROSTATIC LATENT IMAGE DEVELOPING TONER AND ELECTROPHOTOGRAPHIC IMAGE FORMING METHOD

(71) Applicant: Konica Minolta, Inc., Tokyo (JP)

(72) Inventors: Koji Shibata, Hachioji (JP); Kouji Sugama, Hino (JP); Hiroshi Nagasawa, Hachioji (JP); Takaki Kawamura, Hino (JP); Okushi Okuyama, Akiruno (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/293,272

(22) Filed: Jun. 2, 2014

(65) Prior Publication Data

US 2014/0363763 A1 Dec. 11, 2014

(30) Foreign Application Priority Data

Jun. 5, 2013 (JP) ..... 2013-118583

(51) Int. Cl.

| | |
|---|---|
| ***G03G 9/087*** | (2006.01) |
| ***G03G 9/08*** | (2006.01) |
| ***G03G 9/093*** | (2006.01) |

(52) U.S. Cl.

CPC ..... *G03G 9/08724* (2013.01); *G03G 9/0806* (2013.01); *G03G 9/0825* (2013.01); *G03G 9/08755* (2013.01); *G03G 9/08795* (2013.01); *G03G 9/08797* (2013.01); *G03G 9/09321* (2013.01); *G03G 9/09371* (2013.01); *G03G 9/09392* (2013.01)

(58) Field of Classification Search

CPC ..... G03G 9/0825; G03G 9/08724; G03G 9/09392; G03G 9/09321; G03G 9/08795; G03G 9/0806; G03G 9/08755; G03G 9/08797; G03G 9/09371

See application file for complete search history.

(56) References Cited

U.S. PATENT DOCUMENTS

2009/0068578 A1* 3/2009 Murakami et al. ... G03G 9/0808 430/105

FOREIGN PATENT DOCUMENTS

| | | |
|---|---|---|
| JP | 2011-145587 A | 7/2011 |
| JP | 2011-149986 A | 8/2011 |

* cited by examiner

*Primary Examiner* — Peter Vajda

(74) *Attorney, Agent, or Firm* — Lucas & Mercanti, LLP

(57) ABSTRACT

Disclosed is an electrostatic latent image developing toner which contains a toner host particle having a domain-matrix structure. The matrix contains an amorphous resin which contains a vinyl resin having an acid group, the domain contains a crystalline resin which is formed by combining a vinyl polymerized segment and a polyester polymerized segment. A content of the crystalline resin falls within a range from 3 to 30% by mass.

7 Claims, No Drawings

ELECTROSTATIC LATENT IMAGE DEVELOPING TONER AND ELECTROPHOTOGRAPHIC IMAGE FORMING METHOD

CROSS-REFERENCE TO RELATED APPLICATION

This application is based upon and claims the benefit of priority of the prior Japanese Patent Application No. 2013-118583 filed on Jun. 5, 2013, the entire contents of which are incorporated herein by reference.

BACKGROUND OF THE INVENTION

1. Field of the Invention

The present invention relates to an electrostatic latent image developing toner and an electrophotographic image forming method, and more specifically to an electrostatic latent image developing toner and an electrophotographic image forming method using such electrostatic latent image developing toner, which are capable of producing a toner image excellent in heat-resistant storability and cold fixability, and crease fixability.

2. Description of the Related Art

In the conventional process of forming electrophotographic image directed to form a visible image by electrophotography, a heat roller fixation system has been widely used to fix a toner image composed of an electrostatic latent image developing toner (also simply referred to as "toner", hereinafter) onto a transfer medium such as paper, in which the transfer medium, having the toner image formed thereon, is allowed to pass between a heat roller and a press roller for fixation. In order to ensure fixability in the heat roller fixation system, or, adherence of the toner onto the transfer medium such as paper, the heat roller is required to have a large heat capacity.

In recent years, from the viewpoint of preventive measures against global warming, increasing demands for energy saving are also directed to the electrophotographic image forming device. Accordingly, for the electrophotographic image forming devices, particularly for those based on the heat roller fixation system, there have been investigated techniques for reducing heat energy necessary to fix the toner image, that is, techniques for lowering fixation temperature. In order to lower the temperature for fixing the toner, it is necessary to lower melting temperature and melt viscosity of a binder resin which configures the toner host particle. However, by lowering the glass transition point or reducing the molecular weight of the binder resin, aiming at lowering the melting temperature or melt viscosity of the binder resin, the toner will cause other problems, such as degradation in heat-resistant storability, or hot offset.

To address such problems, there have been proposed techniques of improving cold fixability of the toner, by using a crystalline resin and an amorphous resin in combination, as the binder resin composing the toner host particle.

From the viewpoint of improving heat-resistant storability of the toner, there has been proposed a technique of using a styrene-acrylic resin and a crystalline polyester resin in combination [see JP-A-2011-145587 (Patent Document 1) or JP-A-2011-149986 (Patent Document 2), for example]. The crystalline polyester resin is advantageous in that it may readily be designed to have low melting point while keeping the glass transition point (Tg) at a high level. Accordingly, by using the styrene-acrylic resin and the crystalline polyester resin in combination, the hot offset, heat-resistant storability and cold fixability may be improved while making effective use of characteristics of the individual resins, and thereby the toner with an excellent fixability may be obtained.

The technique proposed in JP-A-2011-145587 (Patent Document 1) is directed to improve the cold fixability and post-fixation separability by controlling aspect ratio of the crystalline polyester resin particle, which forms a domain (discrete phase) in the binder resin composing the toner host particle, into a specific range. The toner has, however, suffered from that cracks tend to occur at the boundary between the binder resin and the crystalline polyester resin, so that the toner image may readily crack when paper having the toner image fixed thereon is folded. That is, the toner has suffered from poor crease fixability due to poor folding strength.

Meanwhile, the technique proposed in JP-A-2011-149986 (Patent Document 2) is directed to produce a toner host particle with a core-shell structure, with the shell layer thereof composed of a composite resin which contains a crystalline polyester resin and an amorphous styrene-acrylic resin, and with the core thereof composed of an amorphous resin, and successfully forms the shell layer containing the crystalline polyester resin. The crystalline polyester, however, shows only a poor dispersibility in the shell layer due to poor affinity between the crystalline polyester resin and the styrene-acrylic resin, so that the crystalline polyester partially exposes out on the surface of the toner host particle. The toner may, therefore, fail in achieving a sufficient level of heat-resistant storability.

[Patent Document 1] JP-A-2011-145587

[Patent Document 2] JP-A-2011-149986

The present invention was conceived to address the problems and situation described above, and an object of the invention is to provide an electrostatic latent image developing toner which is excellent in heat-resistant storability and cold fixability, and capable of producing an fixed image with a high crease fixability without causing cracks in the toner image when paper having the toner image fixed thereon is folded; and an electrophotographic image forming method using such electrostatic latent image developing toner.

SUMMARY OF THE INVENTION

While engaged in solving the problems described above and in investigating into causal factors of the problems, the present inventors found out that the problem described above may be solved by an electrostatic latent image developing toner having a domain-matrix structure in which the matrix is configured by an amorphous resin which contains a vinyl resin having an acid group, and the domain is configured by a crystalline resin which is formed by combining a vinyl polymerized segment and a polyester polymerized segment. The findings led us to complete the present invention.

That is, the above-described problems relevant to the present invention may be solved by the means below.

To achieve at least one of the abovementioned objects, provided is an electrostatic latent image developing toner which contains a toner host particle having a domain-matrix structure. The matrix contains an amorphous resin which contains a vinyl resin having an acid group, the domain contains a crystalline resin which is formed by combining a vinyl polymerized segment and a polyester polymerized segment, and a content of the crystalline resin falls in a range from 3 to 30% by mass.

Preferably, the polyester polymerized segment in the crystalline resin has an ester group concentration M, given by the equation (I) below, within the range from 3.5 to 7.1 (mmol/g):

Ester group concentration $M$(mmol/g)=[Average amount by mole of moieties capable of forming ester group contained in polyprotic carboxylic acid and polyhydric alcohol which form 1 mol of polyester polymerized segment(mol/mol)]×1000/[(Total molar mass(g/mol) of polyprotic carboxylic acid and polyhydric alcohol(g/mol))−(Molar mass of water released by dehydration polycondensation(g/mol))×(Amount by mole of ester group (mol/mol) which forms 1 mol of polyester polymerized segment)]. Equation (I):

Preferably, the content of the vinyl polymerized segment in the crystalline resin falls in the range from 5 to 30% by mass.

Preferably, the toner host particle contains a wax, and forms a domain different from that of the crystalline resin.

Preferably, the vinyl resin has an acid group, and the vinyl polymerized segment in the crystalline resin contains a resin obtained by polymerizing an acrylic ester monomer represented by the formula (1) below:

$H_2C{=}CH{-}COOR_1$ Formula (1):

(in the formula (1), $R_1$ represents a $C_{1-8}$ alkyl group).

Preferably, the toner host particle has a core-shell structure which includes a core particle covered with a shell layer, and the core particle has a domain-matrix structure which includes a matrix containing the amorphous resin and a domain containing the crystalline resin.

To achieve at least one of the abovementioned objects, provided is an electrophotographic image forming method which forms an image through at least charging step, exposure step, development step, transfer step and fixation step, and the development step uses the electrostatic latent image developing toner described above.

DETAILED DESCRIPTION OF THE PREFERRED EMBODIMENTS

The electrostatic latent image developing toner of the present invention contains a toner host particle with a domain-matrix structure, wherein the matrix contains an amorphous resin which contains a vinyl resin having an acid group, the domain contains a crystalline resin which is formed by combining a vinyl polymerized segment and a polyester polymerized segment, and the content of the crystalline resin falls in the range from 3 to 30% by mass. This is a technical feature common to all of the claimed invention.

From the viewpoint of demonstrating the effect of the present invention, in one embodiment of the present invention, the ester group concentration M of the polyester polymerized segment in the crystalline resin, given by the equation (I), preferably falls in the range from 3.5 to 7.1 (mmol/g) since the crystalline resin will have a polarity largely different from that of the vinyl resin having an acid group and thereby the crystalline resin will not be compatible with the vinyl resin having an acid group and will be advantageous to form the domain-matrix structure more easily.

If the content of the vinyl polymerized segment in the crystalline resin falls in the range from 5 to 30% by mass, the polymer chains will tangle with each other at the interface between the vinyl resin having an acid group and the crystalline resin, and this advantageously increases strength of the fixed image.

The toner host particle preferably contains a wax and forms a domain different from that of the crystalline resin, since it can demonstrate a mold releasing effect contributed by the wax.

The vinyl resin having an acid group and the vinyl polymerized segment in the crystalline resin preferably contain a resin obtained by polymerizing an acrylic ester monomer represented by the formula (1), since the vinyl resin having an acid group and the vinyl polymerized segment of the crystalline resin will have compositions more close to each other. This is advantageous in terms of obtaining an effect of improving the affinity and an effect of improving strength of image as a consequence.

If the toner host particle has a core-shell structure composed of a core particle covered with a shell layer, with the core particle having a domain-matrix structure composed of the amorphous resin-containing matrix and the crystalline resin-containing domain, the toner will further be improved in the cold fixability. This is advantageous in terms of improving the heat-resistant storability.

The electrostatic latent image developing toner of the present invention is suitably used for an electrophotographic image forming method which forms an image through at least the individual processes of charging step, exposure step, development step, transfer step and fixation step.

The paragraphs below will detail the constituents of the present invention, and modes and embodiments for carrying out the present invention. Note that the wording of "to" with the preceding and succeeding numerals is used to represent a numerical range with the lower and upper limit values defined by the numerals.

(Electrostatic Latent Image Developing Toner)

The electrostatic latent image developing toner of the present invention contains a toner host particle with a domain-matrix structure, the matrix contains an amorphous resin which contains a vinyl resin having an acid group, the domain contains a crystalline resin which is formed by combining a vinyl polymerized segment and a polyester polymerized segment, and the content of the crystalline resin is fallen in the range from 3 to 30% by mass.

The toner host particle in the present invention has a domain-matrix structure. The matrix is composed of an amorphous resin which contains a vinyl resin having an acid group, and the domain contains a crystalline resin formed by combining a vinyl polymerized segment and a polyester polymerized segment. The paragraphs below will explain configuration of the resin and configuration of the toner in order.

(Vinyl Resin Having Acid Group (Matrix))

A resin which composes the matrix is an amorphous resin which contains a vinyl resin having an acid group. The vinyl resin having an acid group contains a resin which is obtained by polymerizing at least a monomer having an acid group.

(Monomer Having Acid Group)

The acid group herein represents an ionic dissociative group such as carboxy group, sulfonic acid group and phosphoric acid group. Among the monomers having an acid group, those having a carboxy group are exemplified by acrylic acid, methacrylic acid, maleic acid, itaconic acid, cinnamic acid, fumaric acid, maleic acid monoalkyl ester, and itaconic acid monoalkyl ester. Those having a sulfonic acid group are exemplified by styrenesulfonic acid, allylsulfosuccinic acid, and 2-acrylamido-2-methylpropanesulfonic acid. Those having a phosphoric acid group is exemplified by acid phosphoxyethyl methacrylate.

Among them, acrylic acid and methacrylic acid are preferable, from the viewpoint of polarity of the surface of latex when formed in an aqueous medium by emulsion polymerization.

Content of the monomer having an acid group which configures the vinyl resin is preferably 4 to 10% by mass. In this range, the vinyl resin will have an appropriate level of polarity, and will stay in the state of phase separation from the crystalline resin without being solubilized. The domain-matrix structure may therefore be formed. Also the cold fixability is improved.

In the present invention, the vinyl resin configured to have an acid group will have a polarity larger than that of the crystalline resin, so that the toner host particle, when manufactured in an aqueous medium, will allow the low-polarity crystalline resin to exist more abundantly inside the toner. This is supposedly why the heat-resistant storability and the cold fixability are successfully balanced.

(Acrylic Ester Monomer)

The vinyl resin having an acid group in the present invention preferably contains, besides the monomer having an acid group, a resin obtained by polymerizing an acrylic ester monomer represented by the formula (1) below.

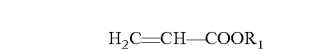

$H_2C{=}CH{-}COOR_1$ Formula (1):

In the formula (1), $R_1$ represents a $C_{1-8}$ alkyl group.

The acrylic ester represented by the formula (1) above is exemplified by methyl acrylate, ethyl acrylate, isopropyl acrylate, n-butyl acrylate, t-butyl acrylate, isobutyl acrylate, n-octyl acrylate, and 2-ethylhexyl acrylate.

(Other Vinyl Monomers)

The vinyl resin having an acid group usable herein includes any other vinyl monomers other than the monomer having an acid group and the acrylic ester monomer represented by the formula (1) described above, and are exemplified by styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene; methacrylic ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate; olefins such as ethylene, propylene and isobutylene; and acrylic or methacrylic derivatives such as acrylonitrile, methacrylonitrile and acrylamide.

Only a single species of these vinyl monomers may be used independently, or two or more species may be used in combination.

(Method for Polymerizing Vinyl Resin Having Acid Group)

While any general method of polymerization is usable for polymerizing the vinyl resin having an acid group, emulsion polymerization is preferably used in the present invention.

(Polymerization Initiator)

Various publicly known polymerization initiators are suitably used as a polymerization initiator in the process of polymerizing the vinyl resin having an acid group. Specific examples include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-hydroperoxide pertriphenyl acetate, tert-butyl performate, tert-butylperacetate, tert-butyl perbenzoate, tert-butyl perphenylacetate, tert-butyl permethoxyacetate, and tert-butyl per N-(3-toluoyl)palmitic acid; and azo compounds such as 2,2'-azobis(2-aminodipropane) hydrochloride, 2,2'-azobis-(2-aminodipropane)nitrate, 1,1'-azobis(sodium 1-methylbutyronitrile-3-sulfonate), 4,4'-azobis(4-cyanovaleric acid) and poly(tetraethylene glycol 2,2'-azobisisobutyrate).

(Chain Transfer Agent)

In the polymerization process of the vinyl resin having an acid group, any of chain transfer agents having been generally used may be employed. The chain transfer agent is exemplified by alkyl mercaptan and mercapto fatty acid ester, without special limitation. The chain transfer agent is preferably mixed with a resin material in advance, in the mixing process.

(Weight-Average Molecular Weight)

Weight-average molecular weight (Mw) of the vinyl resin having an acid group is preferably 7,500 to 100,000, and more preferably 10,000 to 50,000. If the weight-average molecular weight (Mw) is in these ranges, a sufficient level of heat-resistant storability will be obtained. In such ranges, also a sufficient level of anti-hot offset performance will be obtained.

(Method for Measuring Weight-Average Molecular Weight (Mw))

The weight-average molecular weight of the vinyl resin having an acid group is measured by GPC (gel permeation chromatography).

A sample to be measured is dissolved into tetrahydrofuran so as to adjust the concentration to 1 mg/ml. The dissolution is conducted at room temperature for 5 minutes using an ultrasonic disperser. After filtration through a membrane filter with a pore size of 0.2 μm, 10 μL of sample solution is injected into a GPC apparatus.

Conditions of GPC Measurement

Apparatus: HLC-8220 (from Tosoh Corporation)

Column: TSK guard column+TSK gel Super HZM-M, three columns connected in series (from Tosoh Corporation)

Column temperature: 40° C.

Solvent: tetrahydrofuran

Flow rate: 0.2 ml/min

Detector: refractive index (RI) detector

In the measurement of molecular weight of sample, a molecular weight distribution of the sample is calculated based on a calibration curve obtained by measurement of monodisperse standard polystyrene particles. Ten standards of polystyrene are used to prepare the calibration curve.

(Glass Transition Point (Tg))

The glass transition point (Tg) of the vinyl resin having an acid group preferably falls in the range from 35 to 70° C. If the glass transition point is in the range, a sufficient level of heat-resistant storability will be obtained.

(Method for Measuring Glass Transition Point (Tg))

The glass transition point (Tg) of the vinyl resin having an acid group in the present invention may be measured using a differential scanning calorimeter "Diamond DSC" (from PerkinElmer Inc.).

In the measurement, 4.5 to 5.0 mg of resin is precisely weighed to the second decimal place, enclosed in an aluminum pan (Kit No. 0219-0041), and set to a sample holder. A blank aluminum pan was used as the reference. Measurement conditions include a temperature of 0° C. to 200° C., a rate of heating of 10° C./min, a rate of cooling of 10° C./min, with a mode of temperature control of "Heat-Cool-Heat". Data acquired in the second heating was subjected to the analysis.

The glass transition point is determined at an intersection of extension of the base line before a first endothermic peak rises up, and a tangential line which represents the maximum slope between the rise-up point to the apex of the first peak.

(Crystalline Resin (Domain))

The crystalline resin which forms the domain contains a crystalline resin formed by chemically combining the vinyl polymerized segment and the polyester polymerized segment. The crystalline resin is preferably a product formed by combining the vinyl polymerized segment and the polyester polymerized segment while placing a bireactive monomer in between. The polyester polymerized segment is a crystalline polyester. The domain may be added with a wax or the like, besides the crystalline resin.

Content of the crystalline resin in the toner host particle falls in the range from 3 to 30% by mass. In this range, the amorphous resin composing the matrix and the crystalline resin composing the domain stay in the state of phase separation to form a clear domain-matrix structure, without being mixed, thereby the heat-resistant storability may be improved, and a sufficient level of cold fixability may be obtained. If the content is less than 3% by mass, the cold fixability will be less effective, meanwhile if the content exceeds 30% by mass, the heat-resistant storability will degrade.

In the present invention, "crystalline" in the "crystalline resin" means that the resin shows a clear endothermic peak in differential scanning calorimetry (DSC), rather than a stepwise endothermic change. The clear endothermic peak specifically means that the endothermic peak shows a half value width of 15° C. or smaller, in the differential scanning calorimetry (DSC) at a heating rate of 10° C./min.

The crystalline resin preferably has a melting point of 50 to 95° C., and more preferably 55 to 85° C.

If the crystalline resin has the melting point in these ranges, a sufficient level of heat-resistant storability, cold fixability and anti-hot offset performance may be obtained.

The melting point of the crystalline resin may be controlled typically by a resin composition of the polyester polymerized segment as the crystalline polyester.

In the present invention, the melting point of the crystalline resin is measured as follows.

The melting point is specifically measured using a differential scanning calorimeter "Diamond DSC" (from PerkinElmer Inc.), wherein the measurement sequentially undergoes conditions (heating/cooling conditions) which include a heating rate of 10° C./min from 0° C. up to 200° C. in a first heating step, a cooling rate of 10° C./min from 200° C. down to 0° C. in a cooling step, and a heating rate of 10° C./min from 0° C. up to 200° C. in a second heating step. Based on a DSC curve obtained by the measurement, temperature at the apex of the endothermic peak assignable to the crystalline polyester in the first heating step is determined as the melting point. In the measurement, 3.0 mg of a sample to be measured (crystalline resin) is enclosed in an aluminum pan, and set to a sample holder of Diamond DSC. A blank aluminum pan was used as the reference.

The crystalline resin preferably has a weight-average molecular weight (Mw), as measured by gel permeation chromatography (GPC), of 5,000 to 70,000.

(Vinyl Polymerized Segment)

The vinyl polymerized segment composing the crystalline resin contains a resin obtained by polymerizing the vinyl monomer, wherein the vinyl monomer preferably contains a segment obtained by polymerizing an acrylic ester monomer represented by the formula (1) below.

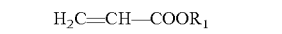

$$H_2C{=}CH{-}COOR_1 \qquad \text{Formula (1):}$$

In the formula (1), $R_1$ represents a $C_{1-8}$ alkyl group.

Specific examples include methyl acryalte, ethyl acrylate, isopropyl acrylate, n-butyl acrylate, t-butyl acrylate, isobutyl acrylate, n-octyl acrylate, and 2-ethylhexyl acrylate. Only a single species of these acrylic ester monomers may be used independently, or two or more species may be used in combination.

The vinyl polymerized segment composing the crystalline resin preferably contains a polymerized segment obtained by polymerizing the monomer represented by the formula (1), and it is preferable that difference in the number of carbon atoms of $R_1$ of the monomer represented by the formula (1) and the number of carbon atoms of correspondent $R_1$ of the acrylic ester monomer composing the vinyl resin having an acid group is 5 or smaller in view of approximating the compositions of the vinyl resin having an acid group and the vinyl polymerized segment of the crystalline resin, to thereby obtain an effect of improving the affinity.

The content of the vinyl polymerized segment in the crystalline resin is preferably 5 to 30% by mass. In this range, a good domain-matrix structure may be obtained, and also the strength of toner image may be enhanced by virtue of a proper level of entanglement of the polymer chains at the interface with the vinyl resin having an acid group.

The vinyl polymerized segment composing the crystalline resin may be a copolymer as combined with an aromatic vinyl monomer, besides the acrylic ester monomer represented by the formula (1) above.

The aromatic vinyl monomer is exemplified by styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene, and derivatives of them.

Only a single species of the aromatic vinyl monomer may be used independently, or two or more species of them may be used in combination.

(Polymerization Initiator)

The polymerization initiator which is used for polymerization of the vinyl resin having an acid group described above may be used as the polymerization initiator used for polymerization of the vinyl polymerized segment composing the crystalline resin.

(Chain Transfer Agent)

In the polymerization of the vinyl polymerized segment composing the crystalline resin, a chain transfer agent may be used for the purpose of controlling the molecular weight of the vinyl polymerized segment. The chain transfer agent usable herein is any of those usable in the polymerization of the above-described vinyl polymerized segment having an acid group described previously.

(Weight-Average Molecular Weight)

The weight-average molecular weight of the vinyl polymerized segment composing the crystalline resin preferably falls in the range from 1,000 to 20,000. If the weight-average molecular weight falls in the range, an advantage is that a clear domain-matrix structure will be formed more easily.

(Polyester Polymerized Segment)

The polyester polymerized segment composing the crystalline resin in the present invention is a crystalline polyester resin manufactured by a polycondensation reaction between a polyprotic carboxylic acid compound and a polyhydric alcohol compound, under the presence of a catalyst.

The polyester polymerized segment preferably has a melting point of 60° C. to 90° C. The weight-average molecular weight (Mw) is preferably 2,000 to 40,000. The crystalline resin preferably has the melting point and the weight-average molecular weight respectively in the ranges described above.

(Polyprotic Carboxylic Acid)

The polyprotic carboxylic acid compound composing the polyester polymerized segment is a sort of compound having two or more carboxyl groups per molecule. Any of alkyl ester, acid anhydride and acid chloride of the polyprotic carboxylic acid compound may be used as the polyprotic carboxylic acid compound.

The polyprotic carboxylic acid is exemplified by diprotic carboxylic acids such as oxalic acid, succinic acid, maleic acid, adipic acid, β-methyladipic acid, azelaic acid, sebacic acid, nonane dicarboxylic acid, decane dicarboxylic acid, undecane dicarboxylic acid, dodecane dicarboxylic acid, fumaric acid, citraconic acid, diglycolic acid, cyclohexane-3,5-diene-1,2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and dodecenylsuccinic acid; and carboxylic acids having three or larger proticity such as trimellitic acid, pyromellitic acid, naphthalene tricarboxylic acid, naphthalene tetracarboxylic acid, pyrene tricarboxylic acid, and pyrene tetracarboxylic acid. In the present invention, the polyprotic carboxylic acid composing the crystalline polyester resin is preferably an aliphatic polyprotic carboxylic acid.

(Polyhydric Alcohol)

The polyhydric alcohol compound is a sort of compound having two or more hydroxy groups per molecule. The polyhydric alcohol compound is exemplified by dihydric alcohols such as ethylene glycol, propylene glycol, butanediol, diethylene glycol, hexanediol, cyclohexanediol, octanediol, decanediol, dodecanediol, ethylene oxide adduct of bisphenol A, and propylene oxide adduct of bisphenol A; and alcohols having three or larger hydricity such as glycerin, pentaerythritol, hexamethylol melamine, hexaethylol melamine, tetramethylol benzoguanamine, and tetraethylol benzoguanamine. In the present invention, an aliphatic polyhydric alcohol is preferably used as the polyhydric alcohol composing the crystalline polyester resin.

(Ester Group Concentration)

The polyester polymerized segment composing the crystalline resin in the present invention preferably has an ester group concentration M of 3.5 to 7.1 (mmol/g).

The "ester group concentration M (mmol/g)" in the present invention represents ratio of ester group in the polyester polymerized segment and is defined by the equation (I) below.

Ester group concentration $M$(mmol/g)=[Average amount by mole of moieties capable of forming ester group contained in polyprotic carboxylic acid and polyhydric alcohol which form 1 mol of polyester polymerized segment(mol/mol)]×1000/[(Total molar mass(g/mol) of polyprotic carboxylic acid and polyhydric alcohol(g/mol))−(Molar mass of water released by dehydration polycondensation(g/mol))×(Amount by mole of ester group (mol/mol) which forms 1 mol of polyester polymerized segment)] Equation (I):

The equation (I) will be explained below.

The polyester resin is generally obtained by a reaction between a polyprotic carboxylic acid compound and a polyhydric alcohol compound, wherein an ester bond is formed by dehydration polycondensation between a carboxy group of the polyprotic carboxylic acid compound and a hydroxy group of the polyhydric alcohol compound. The amount by mole of ester group in the repeating constituent unit of the polyester resin may be determined based on the amounts by mole of the carboxy group of the polyprotic carboxylic acid and the hydroxy group of the polyhydric alcohol, when the polyester resin was synthesized.

More specifically, in the equation (I) above, "Average amount by mole of moieties capable of forming ester group contained in polyprotic carboxylic acid and polyhydric alcohol which form 1 mol of polyester polymerized segment (mol/mol)" means average of amounts by mole of carboxy group and hydroxy group which form 1 mol of the repeating constituent unit of the polyester polymerized segment. Since 1 mol of carboxy group and 1 mol of hydroxy group form 1 mol of ester group (ester bond), so that a value obtained by halving the total of the amount by mole of carboxy group of the polyprotic carboxylic acid compound and the amount by mole of hydroxy group of the polyhydric alcohol compound, which forms the repeating constituent unit of the polyester polymerized segment, represents the amount by mole of ester group in 1 mol of the repeating constituent unit of the polyester polymerized segment.

For example, assuming now that the polyprotic carboxylic acid compound is a diprotic carboxylic acid compound represented by the formula (2) below and that the polyhydric alcohol compound is a dihydric alcohol compound represented by the formula (3) below, then the polyester polymerized segment obtainable from the compounds represented by the formulae (2) and (3) will be given by the formula (4) below.

$$HOOC—R_3—COOH \quad \text{Formula (2)}$$

$$HO—R_4—OH \quad \text{Formula (3)}$$

$$—(—OCO—R_3—COO—R_4—)_n— \quad \text{Formula (4)}$$

The amount by mole of ester group in the repeating constituent unit in the polyester resin represented by the formula (4) represents the amount by mole of ester group formed by the carboxy group in the compound of the formula (2) and the hydroxy group in the compound of the formula (3), and equals to a value obtained by dividing the total of the amount by mole of carboxy group of the carboxylic acid and the amount by mole of hydroxy group of the alcohol by two, and now the amount by mole is 2.

Given that $m_1$ is the molar mass of the diprotic carboxylic acid compound represented by the formula (2), and that $m_2$ is the molar mass of the dihydric alcohol compound represented by the formula (3), then the molar mass $m_3$ per bracketed repeating constituent unit of the polyester resin represented by the formula (4) is given by:

$m_3=(m_1+m_2)$−(Molar mass of water)×[(Total of amounts by mole of carboxy group and hydroxy group)/2], where, [(Total of amounts by mole of carboxy group and hydroxy group)/2] equals to the amount by mole of ester group in the bracketed repeating constituent unit represented by the formula (4).

Accordingly, the ester group concentration M (mmol/g) of the polyester resin, formed by the diprotic carboxylic acid compound and the dihydric alcohol compound, is given by a value obtained by dividing the amount by mole of ester group of the bracketed repeating constituent unit represented by the formula (4), with the molar mass ($m_3$) of the bracketed repeating constituent unit represented by the formula (4), and is calculated by the equation (II) below:

Ester group concentration $M$(mmol/g)=(Amount by mole of ester group in repeating constituent unit of polyester polymerized segment)×1000/(Molar mass of repeating constituent unit of polyester polymerized segment) Equation (II):

Also for the case where two or more species of the polyprotic carboxylic acids or the polyhydric alcohols are used in combination or for the case where the polyprotic carboxylic acid or the polyhydric alcohol having three or larger proticity or hybridity are used in combination, the concentration is calculable from the amount by mole of ester group in the repeating constituent unit and the mass (molar mass) per mole of the repeating constituent unit.

When the ester group concentration is in the above-described range, the crystalline resin will be increased in the hydrophobicity and is prevented from exposing onto the surface of the toner host particle, when the toner host particle is manufactured in an aqueous medium, and will be lowered in the polarity. Accordingly, the crystalline resin will have a polarity value largely different from a polarity value of the vinyl resin having an acid group which composes the matrix and will stay in an independent phase without being solubilized with the vinyl resin having an acid group. A clear domain-matrix structure may therefore be formed.

(Bireactive Monomer)

In the present invention, bireactive monomer is a monomer which links the polyester polymerized segment and the vinyl polymerized segment, and has in the molecule thereof both of a group forming the polyester polymerized segment, selected from hydroxy group, carboxy group, epoxy group, primary amino group and secondary amino group, and an ethylenic unsaturated group forming the vinyl polymerized segment. The monomer preferably has a hydroxy group or carboxy group together with an ethylenic unsaturated group, and more preferably has a carboxy group together with an ethylenic unsaturated group. That is, the monomer is preferably a vinyl carboxylic acid.

The bireactive monomer is exemplified by acrylic acid, methacrylic acid, fumaric acid, maleic acid, and ($C_{1-3}$) hydroxyalkyl esters of them. From the viewpoint of reactivity, acrylic acid, methacrylic acid, and fumaric acid are preferable. While placing the bireactive monomer in between, the polyester polymerized segment and the vinyl polymerized segment are linked.

From the viewpoint of improving the cold fixability, anti-hot offset performance and durability of the toner, the amount of use of the bireactive monomer is preferably 1 to 10 parts by mass per 100 parts by mass in total of the vinyl monomer, and more preferably 4 to 8 parts by mass.

(Method for Manufacturing Crystalline Resin)

The crystalline resin may be manufactured by any of generally known schemes. Representative methods include the three below:

(1) The polyester polymerized segment is preliminarily polymerized, the bireactive monomer is allowed to react with the product, and an aromatic vinyl monomer and (meth) acrylic ester monomer for forming the vinyl polymerized segment is further allowed to react with the product, to thereby form the crystalline resin.

(2) The vinyl polymerized segment is preliminarily polymerized, the bireactive monomer is allowed to react with the product, and the polyprotic carboxylic acid compound and polyhydric alcohol compound for forming the polyester polymerized segment is further allowed to react with the product, to thereby form the crystalline resin.

(3) Each of the polyester polymerized segment and the vinyl polymerized segment is independently polymerized in advance, and the bireactive monomer is then allowed react to link both of them.

While any of the above-described methods of manufacturing is usable in the present invention, a preferable method is (2) the vinyl polymerized segment is preliminarily polymerized, the bireactive monomer is allowed to react with the product, and the polyprotic carboxylic acid compound and polyhydric alcohol compound for forming the polyester polymerized segment is further allowed to react with the product, to thereby form the polyester resin.

More specifically, the polyprotic carboxylic acid compound and polyhydric alcohol compound for forming the polyester polymerized segment, and the vinyl monomer for forming vinyl polymerized segment, and the bireactive monomer are mixed, the polymerization initiator is added to proceed addition polymerization between the vinyl monomer and the bireactive monomer to thereby form the vinyl polymerized segment, and an esterification catalyst is then added to thereby proceed a polycondensation reaction.

Ratio of the polyprotic carboxylic acid compound and the polyhydric alcohol compound in the polycondensation reaction of the polyester polymerized segment, as expressed by equivalence ratio [OH]/[COOH], which involves hydroxy group [OH] of the polyhydric alcohol compound and carboxy group [COOH] of the polyprotic carboxylic acid, is preferably 1.5/1 to 1/1.5, and more preferably 1.2/1 to 1/1.2.

(Catalyst)

Any of various publicly-known catalysts is usable for synthesizing the polyester polymerized segment.

The esterification catalyst is exemplified by tin compounds such as dibutyltin oxide and tin (II) 2-ethylhexanoate, and titanium compounds such as titanium diisopropylate bistriethanolaminate, and esterification promoter is exemplified by gallic acid. Amount of use of the esterification catalyst, per 100 parts by mass in total of the polyhydric alcohol compound and the polyprotic carboxylic acid compound and the bireactive monomer, is preferably 0.01 to 1.5 parts by mass, and more preferably 0.1 to 1.0 parts by mass. Amount of use of the esterification promoter, per 100 parts by mass in total of the polyhydric alcohol compound and the polyprotic carboxylic acid compound and the bireactive monomer, is preferably 0.001 to 0.5 parts by mass, and more preferably 0.01 to 0.1 parts by mass.

The toner host particle in the present invention may optionally be added with colorant, wax, charge control agent or the like.

(Colorant)

For the toner host particle configured to contain a colorant, the colorant is arbitrarily selectable from carbon black, magnetic material, dye, pigment and so forth.

Examples of the carbon black usable herein include channel black, furnace black, acetylene black, thermal black and lamp black.

Examples of the magnetic material usable herein include ferromagnetic metals such as nickel and cobalt, alloys containing these metals, and ferromagnetic metal compounds such as ferrite and magnetite.

Examples of the pigment usable herein include C.I. pigment red 2, ditto 3, ditto 5, ditto 7, ditto 15, ditto 16, ditto 48:1, ditto 48:3, ditto 53:1, ditto 57:1, ditto 81:4, ditto 122, ditto 123, ditto 139, ditto 144, ditto 149, ditto 166, ditto 177, ditto 178, ditto 208, ditto 209, ditto 222, C.I. pigment orange 31, ditto 43, C.I. pigment yellow 3, ditto 9, ditto 14, ditto 17, ditto 35, ditto 36, ditto 65, ditto 74, ditto 83, ditto 93, ditto 94, ditto 98, ditto 110, ditto 111, ditto 138, ditto 139, ditto 153, ditto 155, ditto 180, ditto 181, ditto 185, C.I. pigment green 7, C.I. pigment blue 15:3, ditto 15:4, ditto 60, and phthalocyanine pigments having zinc, titanium, magnesium or the like as the center metal. Also mixtures of these pigments are usable. Examples of the dye usable herein include C.I. solvent red 1, ditto 3, ditto 14, ditto 17, ditto 18, ditto 22, ditto 23, ditto 49, ditto 51, ditto 52, ditto 58, ditto 63, ditto 87, ditto 111, ditto 122, ditto 127, ditto 128, ditto 131, ditto 145, ditto 146, ditto 149, ditto 150, ditto 151, ditto 152, ditto 153, ditto 154, ditto 155, ditto 156, ditto 157, ditto 158, ditto 176, ditto 179, pyrazolotriazole azo dye, pyrazolotriazole azomethine dye, pyrazolone azo dye, pyrazolone azomethine dye, C.I. solvent yellow 19, ditto 44, ditto 77, ditto 79, ditto 81, ditto 82, ditto 93, ditto 98, ditto 103, ditto 104, ditto 112, ditto 162, C.I. solvent blue 25, ditto 36, ditto 60, ditto 70, ditto 93, and ditto 95. Also mixtures of these dyes are usable.

Although depending on the species of the colorant, the number-average primary particle size thereof is preferably 10 to 200 nm or around.

For the toner host particle configured to contain a colorant, ratio of content of the colorant in the toner is preferably 1 to 30% by mass of the binder resin, and more preferably 2 to 20% by mass.

(Wax)

The toner host particle in the present invention may be added with wax as a mold releasing agent. The wax is exemplified by hydrocarbon waxes such as low molecular weight polyethylene wax, low molecular weight polypropylene wax, Fischer-Tropsch wax, micro-crystalline wax, and paraffin wax; and ester-based waxes such as carnauba wax, pentaerythritol behenate, behenyl behenate, and behenyl citrate. Only a single species of them may be used independently, or two or more species may be used in combination.

From the viewpoint of ensuring the cold fixability and mold releasing performance of the toner, the wax preferably has a melting point of 50 to 95° C. Ratio of content of the wax, relative to the total amount of the binder resin, is preferably 2 to 20% by mass, more preferably 3 to 18% by mass, and furthermore preferably 4 to 15% by mass.

The wax preferably exists in the toner host particle so as to form a domain different from that of the crystalline resin. By forming the different domain, the individual functions will more readily be demonstrated. For example, when the toner is manufactured in an aqueous medium, a domain different from that of the crystalline resin will more readily be formed by manufacturing the toner host particle while keeping the wax covered by a resin.

The domain of wax preferably has a diameter of 300 nm to 2 μm. In this range, a sufficient level of mold releasing performance is obtainable.

(Charge Control Agent)

Any of various publicly-known charge control agents is usable in the toner host particle in the present invention.

The charge control agent is selectable from various publicly-known compounds which are dispersible in aqueous media, and is exemplified by nigrosin dye, metal salt of naphthenic acid or higher fatty acid, alkoxylated amine, quaternary ammonium salt compound, azo metal complex, and metal salt or metal complex of salicylic acid.

Ratio of content of the charge control agent, relative to the total amount of the binder resin, is preferably 0.1 to 10% by mass, and more preferably 0.5 to 5% by mass.

(External Additive)

For the toner of the present invention, the toner host particle may be used unmodified, or may be externally added, onto the surface thereof, with any of publicly-known inorganic or organic particles or lubricants, from the viewpoint of improving the charging performance, fluidity or cleaning performance of the toner.

In the present invention, various kinds of external additives may be used in combination. The inorganic particle is exemplified by inorganic oxide particles such as silica particle, alumina particle, and titanium oxide particle; inorganic stearate compound particles such as aluminum stearate particle, and zinc stearate particle; and inorganic titanate compound particles such as strontium titanate, and zinc titanate.

From the viewpoint of heat-resistant storability and environmental stability, these inorganic particles are preferably treated on the surface thereof with silane coupling agent, titanate coupling agent, higher fatty acid or silicone oil.

(Method for Manufacturing Toner)

(Method for Manufacturing Toner Host Particle)

The toner host particle in the present invention may be manufactured by the emulsion flocculation process. More specifically, the toner host particle having the domain-matrix structure may be obtained by mixing an aqueous dispersion of particle of the vinyl resin having an acid group, an aqueous dispersion of particle of crystalline resin composed of the vinyl resin and the crystalline polyester resin, and an aqueous dispersion of colorant particle, allowing the individual particles to flocculate, and then allowing the flocculated particles to fuse with each other.

The toner host particle may further be provided, on the surface thereof, with a shell layer, to make a core-shell structure. By making the core-shell structure, the heat-resistant storability and cold fixability may further be improved.

An exemplary method of manufacturing the colorant-containing toner host particle in the present invention, based on the emulsion flocculation process, includes:

(1) a step of preparing a dispersion liquid of an amorphous resin particle in an aqueous medium;

that is, a step of forming, by polymerization in an aqueous medium, particle of the amorphous resin which contains a vinyl resin having an acid group, to thereby prepare an aqueous dispersion liquid of the amorphous resin particle, having such amorphous resin particle dispersed therein;

(2) a step of preparing, in an aqueous medium, a dispersion liquid of the crystalline resin particle having the vinyl polymerized segment and the polyester polymerized segment linked therein;

(3) a step of preparing, in an aqueous medium, a dispersion liquid of the colorant particle; and (4) a step of mixing the dispersion liquid of the amorphous resin particle, the dispersion liquid of the crystalline resin particle and the dispersion liquid of the colorant particle, allowing the amorphous resin particle, the crystalline resin particle and the colorant particle to flocculate, and then allowing the flocculated particles to fuse with each other.

In more detail, the toner host particle is formed by allowing the amorphous resin particle in the aqueous dispersion, the crystalline resin particle in the aqueous dispersion, and the colorant particle in the aqueous dispersion to flocculate, and further by:

(5) a step of maturing the toner host particle by heat energy, to thereby control the shape thereof.

The toner particle may be manufactured further by a step of collecting the toner host particle by filtration from the aqueous dispersion of the toner host particle, a step of washing the toner host particle in order to remove the surfactant and so forth, a step of drying the thus-washed toner host particle, and, if necessary, an optional step of adding an external additive to the thus-dried toner host particle.

The aqueous dispersion of the host particle after matured in step (5) may additionally be processed by a step of mixing with a resin particle dispersion liquid for forming a shell, so as to form a shell layer over the surface of the toner host particle which serves as a core, to thereby form the toner host particle with the core-shell structure. The process may be followed, similarly as described above, by the washing step, the drying step, and the optional step of adding an external additive.

In the present invention, the "aqueous medium" means a medium composed of 50 to 100% by mass of water, and 0 to 50% by mass of a water-soluble organic solvent. The water-soluble organic solvent is exemplified by methanol, ethanol, isopropanol, butanol, acetone, methyl ethyl ketone, and tetrahydrofuran. Alcoholic organic solvents which do not dissolve the thus-obtained resin are preferable.

(Step of Polymerizing Vinyl Resin Having Acid Group)

The resin particle, which is formed in the process of polymerizing the vinyl resin having an acid group composing the toner host particle, may have a single-layered configuration or may have two or more layers composed of resins of different compositions. In the latter case, the dispersion liquid of the first resin particle prepared by the emulsion polymerization (first stage polymerization) according to general procedures may be added with a polymerization initiator and a polymerizable monomer, and the system may be allowed to polymerize (second stage polymerization). If necessary, a vinyl monomer may further be added so as to allow the third stage polymerization to proceed, to thereby obtain a three-layered configuration.

By configuring the toner host particle in this way, physical properties of the resin, including weight-average molecular weight and glass transition point, composing the individual layers are arbitrarily selectable, so that the characteristics of the toner host particle become controllable depending on purposes.

For the case where a surfactant is used in the process of polymerizing the vinyl resin having an acid group, the surfactant usable herein is as described below.

(Surfactant)

The aqueous medium is preferably added with a dispersion stabilizer for the purpose of preventing the dispersed particles to flocculate.

The dispersion stabilizer usable herein is selectable from various publicly-known surfactants including cationic surfactant, anionic surfactant, and nonionic surfactant.

Specific examples of the cationic surfactant include dodecylammonium bromide, dodecyltrimethylammonium bromide, dodecylpyridinium chloride, dodecylpyridinium bromide and hexadecyltrimethylammonium bromide.

Specific examples of the nonionic surfactant include dodecyl polyoxyethylene ether, hexadecyl polyoxyethylene ether, nonylphenyl polyoxyethylene ether, lauryl polyoxyethylene ether, sorbitan monooleate polyoxyethylene ether, styrylphenyl polyoxyethylene ether and monodecanoyl sucrose.

Specific examples of the anionic surfactant include fatty acid soaps such as sodium stearate, and sodium laurate; and sodium laurylsulfate, sodium dodecylbenzenesulfonate and sodium polyoxyethylene (2) lauryl ether sulfate.

Only a single species of these surfactants may be used independently, or as desired, two or more species may be used in combination.

The toner host particle in the present invention contains, as the binder resin, the amorphous resin which contains a vinyl resin having an acid group, and the crystalline resin formed by combining the vinyl polymerized segment and the polyester polymerized segment, and may optionally contain internal additive(s) such as colorant, wax, charge control agent or magnetic powder. The internal additive of this sort may be introduced into the toner particle by, for example, preliminarily dissolving or dispersing it into a monomer solution for forming the binder resin, in the process of polymerization of the vinyl resin having an acid group.

While the internal additive of this sort may be introduced into the toner particle, by independently preparing a dispersion liquid of an internal additive particle composed only of the internal additive, and then in the step of forming the toner host particle, by allowing the internal additive particle to flocculate together with the resin particle and the colorant particle, it is preferable to introduce in advance the internal additive, in the process of polymerization of the binder resin.

Average particle size of the binder resin particle obtainable in the process of polymerization of the binder resin preferably falls in the range, for example, from 50 to 500 nm in terms of volume-based median diameter.

The volume-based median diameter herein is measured using "UPA-150" (from Microtrack Inc.).

(Step of Dispersing Crystalline Resin Particle)

Methods of converting the crystalline resin into the particle dispersion liquid include a method of mechanically crushing the crystalline resin and then dispersing it in an aqueous medium using a surfactant; a method of putting the crystalline resin preliminarily dissolved in an organic solvent into an aqueous medium, and allowing it to disperse to thereby obtain a dispersion liquid in aqueous medium; a method of mixing the crystalline resin in a molten state with an aqueous medium, and then mechanically dispersing it to thereby obtain a dispersion liquid in aqueous medium; and phase inversion emulsification. Any of these methods is usable in the present invention.

The surfactant usable herein is any of those described previously.

(Step of Preparing Colorant Particle Dispersion Liquid)

The colorant particle dispersion liquid may be prepared by dispersing a colorant into an aqueous medium. The colorant is preferably dispersed while keeping the concentration of the surfactant in the aqueous medium not lower than the critical micelle concentration (CMC), in expectation of homogeneous dispersion of the colorant. Any of various publicly-known dispersers is usable for the dispersion process of the colorant.

The surfactant usable herein is, for example, any of those described previously.

The colorant particle which is dispersed in the colorant particle dispersion liquid, prepared in the step of preparing the colorant particle dispersion liquid, preferably has a diameter of 10 to 300 nm in terms of volume-based median diameter.

The volume-based median diameter of the colorant particle in the colorant particle dispersion liquid is measured by using an electrophoretic light scattering photometer "ELS-800" (from Otsuka Electronics Co., Ltd.).

When a surfactant is used in the process of preparing the colorant particle dispersion liquid, the surfactant may be, for example, any of those exemplified as the surfactant usable in the step of preparing the binder resin particle dispersion liquid described above.

(Toner Host Particle-Forming Step)

In the toner host particle-forming step, particle of any other constituent of the toner, including anti-offset agent such as wax, and charge control agent, may be flocculated together with the vinyl resin having an acid group particle, the crystalline resin particle and the colorant particle.

In one specific method of flocculating and fusing the vinyl resin having an acid group particle, the crystalline resin particle and the colorant particle, a flocculant is added to the aqueous medium so as to adjust the concentration thereof not lower than the critical micelle concentration, the mixture is then heated to a temperature not lower than the glass transition point of the resin particle and not higher than the melting peak temperature of the mixture, so as to proceed salting-out of the particles such as vinyl resin having an acid group particle, the crystalline resin particle and the colorant particle, and to concurrently proceed fusing. Upon completion of the particle growth up to a desired size, a deflocculating agent is added to terminate the growth, and if necessary, the mixture is kept heated thereafter in order to control the shape of particle.

In this method, it is preferable to minimize the time over which the mixture is allowed to stand after added with the flocculant, and to heat the mixture as swiftly as possible up to a temperature not lower than the glass transition point of the resin particle, and not higher than the melting peak temperature of the mixture. While the reason why still remains unclear, this is supposedly because the state of flocculation of the particle would vary to thereby destabilize the particle size distribution depending on the length of time after the salting-out, or because the surface property of the fused particle would vary. The length of time before the heating is preferably 30 minutes or shorter in general, and more preferably 10 minutes or shorter. Rate of heating is preferably 1° C./min or faster. While the upper limit of the rate of heating is not specifically limited, it is preferably set to 15° C./min or slower, from the viewpoint of suppressing generation of coarse particle due to excessively rapid fusion. It is critical to keep the fusion continue, even after the temperature of the reaction system reached a temperature not lower than the glass transition point, by keeping the temperature of the reaction system over a predetermined length of time. In this way, the growth and fusion of the toner host particle may be allowed to proceed in an effective manner, and thereby the toner particle finally obtained may be improved in the durability.

(Flocculant)

The flocculant preferably usable in the step of forming the toner host particle is selectable from metal salt, without special limitation. The metal salt is exemplified by monovalent metal salts such as alkali metal salts including sodium potassium and lithium; divalent metal salts containing calcium, magnesium, manganese and copper, etc.; and trivalent metal salts containing aluminum, etc. Specific examples of the metal salt include sodium chloride, potassium chloride, lithium chloride, calcium chloride, magnesium chloride, zinc chloride, copper sulfate, magnesium sulfate and manganese sulfate. Among them, it is particularly preferable to use divalent metal salts, since they can proceed the flocculation with a smaller amount. Only a single species of them may be used independently, or two or more species may be used in combination.

The particle size of the toner host particle obtained in the step of forming the toner host particle is preferably 2 to 9 μm in terms of volume-based median diameter ($D_{50}$), and more preferably 4 to 7 μm.

The volume-based median diameter of the toner host particle is measured using "Coulter Multisizer 3" (from Beckman Coulter Inc.).

(Shell-Forming Step)

When the toner host particle is configured to have the core-shell structure in the present invention, a binder resin particle dispersion liquid for forming the shell layer is added, in the shell-forming step, to the dispersion liquid of the toner host particle, to thereby allow the shell-forming resin particle to flocculate and fuse on the surface of the toner host particle which serves as the core particle, and to cover the surface of the core particle with the shell layer. The toner host particle with the core-shell structure is thus formed.

More specifically, the dispersion liquid of the toner host particle, while kept at the temperature in the toner host particle-forming step, is added with the dispersion liquid of the shell-forming resin particle which configures the binder resin of the shell, and the shell-forming resin particle is allowed to flocculate and fuse on the surface of the toner host particle slowly over several hours under continued heating and stirring, to thereby form the shell layer of 100 to 300 nm thick over the surface of the toner host particle. The toner host particle with the core-shell structure is thus formed. The heating time under stirring is preferably 1 to 7 hours, and particularly 3 to 5 hours.

(Maturation Step)

While the shape of the toner particle in the toner may be equalized to a certain extent by controlling the heating temperature in the toner host particle-forming step described above, the dispersion liquid preferably goes through a maturation step to further equalize the shape.

In the maturation step, the heating temperature and the heating time are controlled so that the toner host particle, having a constant particle size and a narrow size distribution, will have a smoothened surface and equalized shape. More specifically, the heating temperature is set relatively low in the toner host particle-forming step, so as to suppress the fusion among the resin particles and to promote the equalization, and the heating temperature in the maturation step is again set to relatively low and the heating time is set longer, so that the toner host particle will have a desired level of average roundness, that is, an equalized surface profile.

(Washing Step, Drying Step)

The washing step and the drying step may follow any of various publicly-known methods. For example, the toner host particle is matured to attain a desired level of average roundness in the maturation step, then separated from the liquid phase by a known method such as centrifugation, washed, dried under reduced pressure to remove the organic solvent, and further dried in a known drier such as flash jet drier or fluidized bed drier to remove moisture and a trace amount of organic solvent. The drying temperature may arbitrarily be set so long as the toner will not fuse.

(Step of Adding External Additive)

In the step of adding external additive, the dried toner host particle is optionally added and mixed with external additive(s), to be finished as the toner particle.

While the toner host particle as manufactured up to the drying step may be used unmodified, it is preferable to add particle such as publicly known inorganic particle or organic particle, or lubricant as external an additive, from the viewpoint of further improving the charging performance and fluidity of the toner, or the cleaning performance.

The external additive may be any of combined additives of various species.

The inorganic particle is exemplified by inorganic oxide particles such as silica particle, alumina particle and titanium oxide particle; inorganic stearate compound particles such as aluminum stearate particle and zinc stearate particle; and inorganic titanate compound particles such as strontium titanate and zinc titanate.

The inorganic particle is preferably any of those treated on the surface thereof with a silane coupling agent, titanate coupling agent, higher fatty acid or silicone oil, from the viewpoint of heat-resistant storability and environmental stability.

Amount of addition of the external additive is 0.05 to 5 parts by mass per 100 parts by mass of the toner host particle, and preferably 0.1 to 3 parts by mass.

A typical method of adding the external additive relates to a dry process by which the external additive in a powder form is added to the dried toner host particle. A mixer used herein is exemplified by any of mechanical mixers including Henschel mixer and coffee mill.

(Toner)

The "toner" of the present invention contains the "toner host particle". While the "toner host particle" may be used unmodified as the "toner", the "toner particle" in the general sense is the "toner host particle" added with the external additive. The "toner" means a gathering of the "toner particle".

(Average Particle Size of Toner Particle)

The average particle size of the toner particle relevant to the present invention is preferably 3 to 10 μm, for example, in terms of volume-based median diameter ($D_{50}$). When the toner particle is manufactured for example by the emulsion flocculation described later, the particle size is controllable by the concentration of the flocculant to be used, amount of addition of the organic solvent, time of fusing, and composition of polymer.

By controlling the volume-based median diameter within the above-described range, a true reproduction of an extra-fine dot image of a level of 1,200 dpi (dots per inch (2.54 cm)) for example is obtainable.

The volume-based median diameter of the toner particle is measured and calculated using a measurement instrument which employs "Multisizer 3" (from Beckman Coulter Inc.)), connected with a computer system installed with data processing software "Software V3.51". More specifically, 0.02 g of toner is added to 20 ml of a surfactant solution (prepared for the purpose of dispersing the toner particle, typically by diluting a neutral detergent which contains the surfactant component ten-fold with pure water) for conditioning, and then dispersed by sonication for one minute to thereby prepare a toner particle dispersion liquid. The toner particle dispersion liquid is injected through a pipette into a beaker in a sample stand, which contains "ISOTON II" (from Beckman Coulter Inc.), so that the concentration, monitored on a display of the measurement instrument, reaches 8%. By adjusting the concentration to this concentration level, measurement values will be more reproducible. A frequency value is calculated by the measurement instrument under conditions including a measured particle count of 25,000, and an aperture diameter of 100 μm, and a particle diameter corresponded to 50% on the scale of volume cumulative fraction is determined as the volume-based median diameter.

(Average Roundness of Toner Particle)

The toner of the present invention preferably has arithmetic mean roundness, given by the equation (III) below, of 0.850 to 0.990 for every toner particle composing the toner, from the viewpoint of improving the transfer efficiency:

Roundness=(Circumferential length of true circle having the same area with that of projected image of particle)/(Circumferential length of projected image of particle) Equation (III):

Now, the mean roundness of the toner particle is measured by a flow particle image analyzer "FPIA-2100" (from Sysmex Corporation).

More specifically, the toner particle is wetted in an aqueous surfactant solution, dispersed by sonication for one minute, and then subjected to measurement using the flow particle image analyzer "FPIA-2100", in the HPF (high-power field) mode, at an appropriate concentration so as to give the number of particles detectable in HPF of 3,000 to 10,000. In this range, the measurement value is obtainable in a highly reproducible manner.

[Developer]

While the toner of the present invention is usable as a single-component developer composed of a magnetic of non-magnetic component, it may alternatively be used as a two-component developer as mixed with a carrier.

The carrier usable herein may be any of publicly-known magnetic particles composed of metals such as iron, ferrite and magnetite, or alloys of the metal combined with a metal such as aluminum or lead. Among them, ferrite particle is preferably used. The carrier usable herein may be a coated carrier which contains the magnetic particle covered on the surface thereof with a coating material such as resin, or a resin-dispersed carrier configured by dispersing the magnetic particle into a binder resin.

The carrier preferably has a volume-based average particle size of 15 to 100 μm, and more preferably 25 to 80 μm.

(Electrophotographic Image Forming Method)

The electrostatic latent image developing toner of the present invention is usable in various publicly-known image forming methods based on the electrophotographic system. For example, it is usable in monochromatic or full-color image forming method. The full-color image forming method is exemplified by a method of using a four-cycle system configured by four color developing units for yellow, magenta, cyan and black, and a single electrostatic latent image carrier (also referred to as "electrophotographic photoconductor" or simply as "photoconductor"); and a method of using a tandem system configured by color-wise image forming units each being composed of a color developing device and an electrostatic latent image carrier for every color, either of them is usable.

A typical specific procedure of the electrophotographic image forming method using the electrostatic latent image developing toner of the invention includes: charging an electrostatic latent image carrier by a charging device (charging step); forming the electrostatic latent image by exposing (exposure step); and developing and visualizing the latent image in a developing device using an electrostatic latent image developer by charging the toner with the carrier contained in the electrostatic latent image developer (developing step). The toner image is transferred onto a paper (transfer step), and the transferred toner image is fixed onto the paper under contact-heating (fixation step), to thereby obtain a visualized image.

By means of the present invention, it becomes now possible to provide an electrostatic latent image developing toner which is excellent in heat-resistant storability and in cold fixability, which can yield a toner image unlikely to crack even if paper having the toner image formed thereon were folded, and can form a fixed image with a high crease fixability; and to provide an electrophotographic image forming method which uses the electrostatic latent image developing toner.

Although not yet fully clarified, a mechanism of demonstrating the effect of the present invention and an action mechanism are supposed as follows.

In the toner of the present invention, the toner host particle is configured by using, as the matrix, an "amorphous resin which contains a vinyl resin having an acid group" (also simply referred to as "amorphous resin" hereinafter) which is excellent in heat-resistant storability and by using, as the domain, a "crystalline resin formed by combining a vinyl polymerized segment and a polyester polymerized segment" (also simply referred to as "crystalline resin" hereinafter) which is excellent in cold fixability.

The domain-matrix structure herein means a structure having a continuous matrix phase, and distributed therein a domain phase which has a closed interface (boundary between phase and phase). Such structure may be observed on a cross section of an osmium-dyed toner particle under a transmission electron microscope by a general method. When slices are prepared using an ultramicrotome, the thickness of the section is set to 100 nm.

In the present invention, the toner host particle is preferably produced in an aqueous medium. The vinyl resin used for the binder resin is an amorphous resin which contains a vinyl resin having an acid group. Since the vinyl resin has an acid group and has therefore a relatively high polarity, so that the vinyl resin shows a high affinity with the aqueous medium. On the other hand, the crystalline resin will be lowered in affinity with the aqueous medium when the ester group concentration in the polyester polymerized segment is reduced.

Additionally, because the vinyl resin having an acid group shows high affinity with the vinyl polymerized segment of the crystalline resin, so that the vinyl polymerized segment of the crystalline resin is oriented to the side closer to the vinyl resin having an acid group. In other words, the domain is supposed to be formed while directing the polyester polymerized segment inwardly and while allowing the vinyl polymerized segment of the crystalline resin to relatively expose to the surface side thereof. The vinyl polymerized segment exposed to the surface of the domain orients towards a moiety of the high-affinity vinyl resin having an acid group, which composes the matrix and can thereby form the toner host particle with the domain-matrix structure. The heat-resistant storability and the cold fixability are balanced in this way.

Since the vinyl resin having an acid group shows a high affinity with the vinyl polymerized segment of the crystalline resin, so that the interface between the vinyl resin having an acid group and the vinyl polymerized segment of the crystalline resin is strengthened, and this makes the toner unlikely to crack at the interface between the domain and the matrix. This is supposedly why the folding strength of the toner image is improved, and also the crease fixability is improved.

Further by configuring the toner host particle with a core-shell structure, in which the core is composed of a particle having a domain-matrix structure composed of the vinyl resin having an acid group and the crystalline resin, and the shell is provided on the surface of the core, it is further supposed to be possible to make the toner host particle more excellent in the heat-resistant storability and cold fixability.

EXAMPLES

The present invention will specifically be explained referring to Examples. The present invention is, however, not limited thereto.

(Manufacture of Toner 1)

(Preparation of Resin Particle Dispersion Liquid for Toner)

(Preparation of Dispersion Liquid (1) of Particle of Vinyl Resin Having Acid Group)

(First Stage Polymerization)

Into a reaction vessel equipped with a stirrer, a temperature sensor, a condenser tube, and a nitrogen injector, 4 parts by mass of sodium polyoxyethylene (2) dodecyl ether sulfate and 3,000 parts by mass of deionized water were put, the content was kept stirred at 230 rpm under nitrogen gas flow, and the inner temperature was elevated to 80° C. After heated, 10 parts by mass of potassium persulfate dissolved in 200 parts by mass of deionized water was added, the liquid temperature was kept at 75° C., and a mixed monomer solution composed of:

| | |
|---|---|
| styrene | 584 parts by mass |
| n-butyl acrylate | 160 parts by mass |
| methacrylic acid | 56 parts by mass |

was dropped over one hour, and the content was allowed to polymerize while heated at 75° C. for 2 hours under stirring. A dispersion liquid of resin particle (b1) was thus prepared.

(Second Stage Polymerization)

Into a reaction vessel equipped with a stirrer, a temperature sensor, a condenser tube, and a nitrogen injector, a solution prepared by dissolving 2 parts by mass of sodium polyoxyethylene (2) dodecyl ether sulfate into 3,000 parts by mass of deionized water was put, the content was heated to 80° C., added with a solution obtained by dissolving, at 80° C., 42 parts by mass (solid content conversion) of the above-described resin particle (b1) and 70 parts by mass of microcrystalline wax "HNP-0190" (from Nippon Seiro Co., Ltd.) into a monomer solution composed of:

| | |
|---|---|
| styrene | 239 parts by mass |
| n-butyl acrylate | 111 parts by mass |
| methacrylic acid | 26 parts by mass |
| n-octylmercaptan | 3 parts by mass, |

and then mixed and dispersed for one hour using a mechanical disperser "CLEARMIX" (from M Technique Co., Ltd.) having a circulation path. A dispersion liquid containing emulsified particle (oil droplet) was thus prepared.

Next, to the dispersion liquid, added was an initiator solution prepared by dissolving 5 parts by mass of potassium persulfate into 100 parts by mass of deionized water. The system was heated at 80° C. for one hour under stirring so as to proceed therein polymerization. A dispersion liquid of resin particle (b2) was thus prepared.

(Third Stage Polymerization)

To the dispersion liquid of resin particle (b2) obtained above, a solution prepared by dissolving 10 parts by mass of potassium persulfate into 200 parts by mass of deionized water was added, the content was kept at 80° C., and a mixed monomer solution composed of:

| | |
|---|---|
| styrene | 380 parts by mass |
| n-butyl acrylate | 132 parts by mass |
| methacrylic acid | 39 parts by mass |
| n-octylmercaptan | 6 parts by mass |

was dropped over one hour. After the dropping, the content was stirred for 2 hours under heating so as to proceed polymerization, and then cooled to 28° C., to thereby obtain a dispersion liquid (1) of particle of a vinyl resin having an acid group.

(Preparation of Dispersion Liquids (2) to (6) of Particles of Vinyl Resins Having Acid Groups)

Dispersion liquids (2) to (6) of the particles of the vinyl resins having acid groups were prepared in the same way, but varying the monomer composition as summarized in Table 1, from that of the dispersion liquid (1) of particle of a vinyl resin having an acid group.

TABLE 1

| No. of dispersion liquid of vinyl resin particies having acid group (amorphous resin) | first stage polymerization St (part by mass) | BA (part by mass) | MAA (part by mass) | AA (part by mass) | second stage polymerization St (part by mass) | BA (part by mass) | MAA (part by mass) | AA (part by mass) | third stage polymerization St (part by mass) | BA (part by mass) | MAA (part by mass) | AA (part by mass) |
|---|---|---|---|---|---|---|---|---|---|---|---|---|
| (1) | 584 | 160 | 56 | — | 239 | 111 | 26 | — | 380 | 132 | 39 | — |
| (2) | 606 | 138 | — | 56 | 247 | 103 | — | 26 | 390 | 121 | — | 39 |
| (3) | 616 | 152 | 32 | — | 253 | 108 | 15 | — | 402 | 126 | 22 | — |
| (4) | 550 | 170 | 80 | — | 222 | 116 | 38 | — | 357 | 138 | 55 | — |
| (5) | 663 | 137 | — | — | 274 | 102 | — | — | 432 | 118 | — | — |
| (6) | 545 | 199 | 56 | — | 217 | 133 | 26 | — | 349 | 165 | 39 | — |

St: styrene
BA: n-butyl acrylate
MAA: methacrylic acid
AA: acrylic acid (Preparation of Shell-Forming Dispersion Liquid (1) of Vinyl Resin Particle)

To 1,390 parts by mass of deionized water, a polymerization initiator solution prepared by dissolving 8.5 parts by mass of potassium persulfate into 200 parts by mass of deionized water was added, and under a temperature condition of 80° C., a monomer mixture solution containing 292 parts by mass of styrene, 86 parts by mass of n-butyl acrylate, 42 parts by mass of methacrylic acid, and 8.2 parts by mass of n-octylmercaptan was dropped over 2 hours. After completion of the dropping, the mixture was allowed to polymerize under heating and stirring for 2 hours, and then cooled to 28° C. A shell-forming dispersion liquid (1) of vinyl resin particle was thus obtained.

(Synthesis of Crystalline Resin 1)

Into a reaction vessel equipped with a nitrogen injector, a dehydrating tube, a stirrer and a thermocouple, 259 parts by mass of sebacic acid (MW 202.25) as the polyprotic carboxylic acid compound, and 259 parts by mass of 1,12-dodecanediol (MW 202.33) as the polyhydric alcohol compound, both being materials of the polyester polymerized segment, were put, and heated to 160° C. for dissolution. A solution preliminarily prepared by mixing 46 parts by mass of styrene, 12 parts by mass of n-butyl acrylate, 4 parts by mass of dicumyl peroxide, and 3 parts by mass of acrylic acid as the bireactive monomer, all of which being materials for composing the vinyl polymerized segment, was dropped through a dropping funnel over one hour. The content was kept stirred for one hour, with the temperature kept at 170° C., so as to polymerize styrene, n-butyl acrylate and acrylic acid, and then added with 2.5 parts by mass of tin (II) 2-ethylhexanoate, and 0.2 parts by mass of gallic acid, heated to 210° C., and the content was allowed to react for 8 hours. The content was further allowed to react at 8.3 kPa for one hour, to thereby obtain crystalline resin 1.

The thus obtained crystalline resin 1 was subjected to measurement as described above using a differential scanning calorimeter "Diamond DSC" (from PerkinElmer Inc.) at a heating and cooling rate of 10° C./min to obtain a DSC curve, and the melting point (Tm) was found to be 82.2° C. by the method of finding temperature at the apex of the endothermic peak. The molecular weight Mw, measured as described above using GPC "HLC-8120GPC" (from Tosoh Corporation), was found to be 28,000, as calibrated by standard polystyrene.

(Preparation of Dispersion Liquid 1 of Crystalline Resin Particle)

Thirty parts by mass of crystalline resin 1 was melted, and transferred as melted to an emulsifier/disperser "Cavitron CD1010" (from Eurotec Co., Ltd.) at a rate of transfer of 100 parts by mass per minute. Concurrently with the transfer of the molten crystalline resin 1, also a dilute aqueous ammonia solution with a concentration of 0.37% by mass, prepared by diluting 70 parts by mass of a reagent aqueous ammonia solution with deionized water in an aqueous solvent tank, was transferred to the emulsifier/disperser, under heating at 100° C. by a heat exchanger at a rate of transfer of 0.1 liter per minute. The emulsifier/disperser was operated at a rotating speed of rotor of 60 Hz, and a pressure of 5 kg/cm$^2$, to prepare dispersion liquid (1) of a crystalline resin particle with a volume-based median diameter of 200 nm, and a solid content of 30 parts by mass.

(Synthesis of Crystalline Resins 2 to 9 and Preparation of Dispersion Liquids 2 to 9 of Crystalline Resin Particles)

Crystalline resins 2 to 9 were prepared according to the compositions of the individual monomers as summarized in Table 2, and dispersion liquids 2 to 9 of the crystalline resin particles were prepared in the same way as the dispersion liquid 1 of the crystalline resin particle.

TABLE 2

| | vinyl polymerized segment | | | | | | | | | | |
|---|---|---|---|---|---|---|---|---|---|---|---|
| | vinyl monomer | | | | bireactive monomer | polyester polymerized segment | | | | ester group con- | |
| | | acrylate ester | | | | dicarboxylic acid | | diol | | | |
| crystalline resin No. | styrene (part by mass) | compound name | (part by mass) | content (% by mass) | acrylic acid (part by mass) | compound name | (part by mass) | compound name | (part by mass) | centration M (mmol/g) | melting point (° C.) |
| 1 | 46 | butyl acrylate | 12 | 10 | 3 | sebacic acid | 259 | 1,12-dodecanediol | 259 | 5.43 | 82.2 |
| 2 | 23 | butyl acrylate | 6 | 5 | 2 | sebacic acid | 274 | 1,12-dodecanediol | 274 | 5.43 | 82.5 |
| 3 | 137 | butyl acrylate | 36 | 30 | 9 | sebacic acid | 202 | 1,12-dodecanediol | 202 | 5.43 | 81.0 |
| 4 | 46 | butyl acrylate | 12 | 10 | 3 | sebacic acid | 327 | 1,6-hexanediol | 191 | 7.03 | 66.2 |

TABLE 2-continued

| | vinyl polymerized segment | | | | | | | | | | |
|---|---|---|---|---|---|---|---|---|---|---|---|
| | vinyl monomer | | | | bireactive monomer | polyester polymerized segment | | | | ester group concentration M (mmol/g) | melting point (° C.) |
| | | acrylate ester | | | | dicarboxylic acid | | diol | | | |
| crystalline resin No. | styrene (part by mass) | compound name | (part by mass) | content (% by mass) | acrylic acid (part by mass) | compound name | (part by mass) | compound name | (part by mass) | | |
| 5 | 46 | butyl acrylate | 12 | 10 | 3 | sebacic acid | 396 | ethylene glycol | 122 | 8.76 | 82.2 |
| 6 | 46 | butyl acrylate | 12 | 10 | 3 | 1,18-octadecane dicarboxylic acid | 295 | 1,16-hexadecanediol | 223 | 3.54 | 78.0 |
| 7 | 40 | butyl acrylate | 18 | 10 | 3 | sebacic acid | 220 | 1,12-dodecanediol | 298 | 5.43 | 82.2 |
| 8 | 48 | 2-ethylhexyl acrylate | 10 | 10 | 3 | sebacic acid | 220 | 1,12-dodecanediol | 298 | 5.43 | 82.2 |
| 9 | 0 | — | 0 | 0 | 0 | sebacic acid | 220 | 1,12-dodecanediol | 298 | 5.43 | 82.2 |

(Preparation of Colorant Particle Dispersion Liquid (Bk))

Ninety parts by mass of sodium sulfate was dissolved into 1,600 parts by mass of deionized water under stirring. The solution was kept stirred, gradually added with 420 parts by mass of carbon black "Regal 330R" (from Cabot Corporation), and then dispersed using a stirrer "Cleamix" (from M Technique Co., Ltd.), to thereby prepare a colorant particle dispersion liquid (Bk).

The particle size of the colorant particle in the colorant particle dispersion liquid (Bk), measured by using an electrophoretic light scattering photometer "ELS-800" (from Otsuka Electronics Co., Ltd.), was found to be 110 nm.

(Formation of Toner 1)

(Manufacture of Toner Host Particle (1))

(Flocculation and Fusing Step)

Into a reaction vessel equipped with a stirrer, a temperature sensor, a condenser tube and a nitrogen injector, 300 parts by mass (solid content conversion) of the dispersion liquid (1) of the vinyl resin particle having an acid group, 60 parts by mass (solid content conversion) of the dispersion liquid 1 of the crystalline resin particle, 1,100 parts by mass of deionized water, and 40 parts by mass (solid content conversion) of colorant particle dispersion liquid [Bk] were put, the temperature of liquid was adjusted to 30° C., and pH was adjusted to 10 using a 5N aqueous sodium hydroxide solution. An aqueous solution prepared by dissolving 60 parts by mass of magnesium chloride into 60 parts by mass of deionized water was then added under stirring, at 30° C. over 10 minutes. After kept for 3 minutes, the temperature of the system was begun to elevate, up to 85° C. over 60 minutes, and the particles were allowed to continue flocculation and growth while kept at 85° C. In this state, the particle size of the flocculated particle was measured using "Coulter Multisizer 3" (from Beckman Coulter Inc.), and when the volume-based median diameter reached 6 μm, the growth of the particle was terminated by adding an aqueous solution prepared by dissolving 40 parts by mass of sodium chloride into 160 parts by mass of deionized water. The liquid was further kept stirred under heating at 80° C. for one hour for maturation, so as to allow the particles to fuse. The dispersion liquid of the toner host particle 1 was thus prepared.

(Washing and Drying Step)

The thus manufactured toner host particle is separated from the liquid phase using a basket centrifuge machine "MARK III Model 60×40+M" (from Matsumoto Machine Co., Ltd.), to produce a wet cake of the toner host particle. The wet cake was washed with deionized water at 40° C. using the basket centrifuge machine, until the filtrate shows an electrical conductivity as low as 5 μS/cm, transferred to "Flash Jet Drier" (from Seishin Enterprise Co., Ltd.), and then dried until the moisture content decreased down to 0.5% by mass. Toner host particle (1) was thus manufactured.

(Step of Adding External Additive)

The toner host particle (1) was added with 1% by mass of hydrophobic silica (number-average primary particle size=12 nm) and 0.3% by mass of hydrophobic titania (number-average primary particle size=20 nm), and mixed in a Henschel mixer, to thereby manufacture toner 1.

(Manufacture of Toners 2 to 13 and Toners 15 to 19)

Toners 2 to 14 and 16 to 17 were manufactured in the same way with toner 1, except that the amorphous resin and the crystalline resin followed the compositions listed in Table 3. Toner 15 could not be formed, since the crystalline resin could not successfully be incorporated into the toner.

(Manufacture of Toner 14)

In a reaction vessel equipped with a stirrer, a temperature sensor, a condenser tube and a nitrogen injector, 270 parts by mass (solid content conversion) of the dispersion liquid (6) of the vinyl resin particle having an acid group, 60 parts by mass (solid content conversion) of the dispersion liquid 1 of the crystalline resin particle, 1,100 parts by mass of deionized water, and 40 parts by mass (solid content conversion) of the colorant particle dispersion liquid [Bk] were put, the temperature of liquid was adjusted to 30° C., and pH was adjusted to 10 using a 5N aqueous sodium hydroxide solution. An aqueous solution prepared by dissolving 60 parts by mass of magnesium chloride into 60 parts by mass of deionized water was then added under stirring, at 30° C. over 10 minutes. After kept for 3 minutes, the temperature of the system was begun to elevate, up to 85° C. over 60 minutes, and the particles were allowed to continue flocculation and growth while kept at 85° C. In this state, the particle size of the flocculated particle was measured using "Coulter Multisizer 3" (from Beckman Coulter Inc.), and when the volume-based median diameter reached 5.5 μm, 30 parts by mass (solid content conversion) of the shell-forming dispersion liquid (1) of vinyl resin particle, as a shell material, was added.

Then an aqueous solution prepared by dissolving 2 parts by mass of magnesium chloride hexahydrate into 2 parts by mass of deionized water was added over 10 minutes. The mixture was kept stirred until the volume-based median diameter ($D_{50}$) of the particle reached 6 μm. Upon reaching, an aqueous solution prepared by dissolving 40 parts by mass of sodium chloride in 160 parts by mass of deionized water was added to terminate the particle growth, and the mixture was further stirred under heating at 80° C. for one hour for maturation, so as to allow the particles to fuse. Dispersion liquid of toner host particle 14 was thus prepared.

The dispersion liquid of toner host particle 14 was then subjected to solid-liquid separation in the same way as the dispersion liquid 1 of the toner host particle, followed by washing and drying, to thereby obtain toner host particle 14 with the core-shell structure. The thus-obtained toner host particle 14 was further added with an external additive, to thereby manufacture toner 14.

Toners 1 to 14, 16, 18 and 19, after dyed with ruthenium and observed in the cross section thereof, were found to have the domain assignable to the crystalline resin.

experiments showing no visually observable blot due to cold offset, was evaluated as the lower limit fixation temperature. The toners showing the lower limit fixation temperature of 140° C. or below were determined as "acceptable". The lower the lower limit fixation temperature, the better the cold fixability.

(Evaluation 2: Crease Fixability)

The sample to be evaluated was measured with respect to crease fixability, and a temperature at which the ratio of crease fixation exceeded 80% was defined as the lowest fixation temperature. The toners showing the lowest fixation temperature of 140° C. or below were determined as "acceptable".

TABLE 3

| | dispersion liquid of vinyl resin particles having acid group (amorphous resin) | | | crystalline resin | | | | | | |
|---|---|---|---|---|---|---|---|---|---|---|
| toner No. | No. of dispersion liquid of vinyl resin particles | acrylic acid type | rate of acrylic acid type (% by mass) | crystalline resin No. | content of vinyl polymerized segment (% by mass) | ester group concentration M (mmol/g) | melting point of crystalline resin (° C.) | content of crystalline resin (% by mass) | shell | remarks |
| toner 1 | (1) | methacrylic acid | 7.0 | 1 | 10 | 5.43 | 82.2 | 15.0 | none | present invention |
| toner 2 | (2) | acrylic acid | 7.0 | 1 | 10 | 5.43 | 82.2 | 15.0 | none | present invention |
| toner 3 | (3) | methacrylic acid | 4.0 | 1 | 10 | 5.43 | 82.2 | 15.0 | none | present invention |
| toner 4 | (4) | methacrylic acid | 10.0 | 1 | 10 | 5.43 | 82.2 | 15.0 | none | present invention |
| toner 5 | (1) | methacrylic acid | 7.0 | 2 | 5 | 5.43 | 82.5 | 15.0 | none | present invention |
| toner 6 | (1) | methacrylic acid | 7.0 | 3 | 30 | 5.43 | 81.0 | 15.0 | none | present invention |
| toner 7 | (1) | methacrylic acid | 7.0 | 6 | 10 | 3.54 | 78.0 | 15.0 | none | present invention |
| toner 8 | (1) | methacrylic acid | 7.0 | 4 | 10 | 7.03 | 66.2 | 15.0 | none | present invention |
| toner 9 | (1) | methacrylic acid | 7.0 | 5 | 10 | 8.76 | 82.2 | 15.0 | none | present invention |
| toner 10 | (1) | methacrylic acid | 7.0 | 1 | 10 | 5.43 | 82.2 | 3.0 | none | present invention |
| toner 11 | (1) | methacrylic acid | 7.0 | 1 | 10 | 5.43 | 82.2 | 30.0 | none | present invention |
| toner 12 | (1) | methacrylic acid | 7.0 | 7 | 10 | 5.43 | 82.2 | 15.0 | none | present invention |
| toner 13 | (1) | methacrylic acid | 7.0 | 8 | 10 | 5.43 | 82.2 | 15.0 | none | present invention |
| toner 14 | (6) | methacrylic acid | 7.0 | 1 | 10 | 5.43 | 82.2 | 15.0 | * | present invention |
| toner 15 | (5) | — | — | 1 | 10 | 5.43 | 82.2 | 15.0 | none | comparison |
| toner 16 | (1) | methacrylic acid | 7.0 | 9 | — | 5.43 | 82.2 | 13.5 | none | comparison |
| toner 17 | (1) | methacrylic acid | 7.0 | — | — | — | — | — | none | comparison |
| toner 18 | (1) | methacrylic acid | 7.0 | 1 | 10 | 5.43 | 82.2 | 1.0 | none | comparison |
| toner 19 | (1) | methacrylic acid | 7.0 | 1 | 10 | 5.43 | 82.2 | 35.0 | none | comparison |

* vinyl resin particles dispersion liquid (1) for shell (Preparation of Developers 1 to 14, and 16 to 19)

The toners 1 to 14 and 16 to 19 described above were mixed with a ferrite carrier with a volume-average particle size of 60 μm, so as to adjust the toner concentration to 6% by mass, to thereby manufacture developers 1 to 14 and 16 to 19, and the developers were subjected to evaluation below. The mixing herein was conducted using a V-type mixer for 30 minutes.

(Evaluation)

Using the thus-manufactured developers 1 to 14 and 16 to 19, toners 1 to 14 and 16 to 19 were evaluated as follows.

(Evaluation 1: Cold Offset Performance)

As an index for evaluating cold fixability, the cold offset performance was evaluated.

A full-color copying machine "Bizhub PRO C6550" (from Konica Minolta Inc.) was modified in the fixation unit so as to enable temperature control of the surface of the heating roller (fixing temperature) in the range from 120 to 200° C. In an fixation experiment carried out under a normal-temperature, normal-humidity environment (20° C., 50% RH), a solid image with an amount of adhesion of toner of 8 mg/cm$^2$ was formed on a A4 wood-free paper, and repetitively fixed while elevating the fixation temperature from 120° C. at 5° C. intervals up to 200° C.

The fixing temperature in a fixation experiment which showed the lowest fixing temperature, among the fixation The crease fixability (strength) was evaluated by the fixing ratio of the toner image on a crease (pleat) of a sheet of paper. More specifically, a degree of scaling-off of the toner was evaluated by folding the sheet of paper based on the fixing ratio which represents a degree of scaling-off of toner at a folded portion, when the sheet of paper was folded with the fixed image directed inward.

In the measurement, the sheet of paper was folded with a solid image (image density=0.8) directed inward, the crease was rubbed three times with fingers, the paper was unfolded, the solid image was wiped with "JK wiper" (from Nippon Paper Crecia Co., Ltd.) three times, and the fixing ratio was calculated by the equation (IV) below, referring to the image density values on the crease before and after the folding.

$$\text{Fixing ratio}(\%)=\{(\text{Image density after folding})/(\text{Image density before folding})\}\times 100 \qquad \text{Equation (IV):}$$

It is understood that the higher the fixing ratio, the better the crease fixability, that is, the larger the strength of toner image.

(Evaluation 3: Heat-Resistant Storability)

As an index for heat-resistant storability of the toner, ratio of flocculation of the toner was evaluated.

Into a 10-mL glass bottle with an inner diameter of 21 mm, 0.5 g each of the above-described toners 1 to 14 and 16 to 19 was sampled, the bottle was closed with a lid, shaken at room temperature 600 times using a tap denser "KYT-2000" (from Seishin Enterprise Co., Ltd.), and allowed to stand with the lid removed in an environment of 55° C., 35% RH for 2 hours. Next, the toner was carefully placed on a 48-mesh sieve (opening=350 μm) so as not to crack an aggregate of the toner, the sieve was set to a powder characteristics tester "PT-R" (from Hosokawa Micron Corporation), fixed by presser bars and knob nuts, and vibrated for 10 seconds under a vibration strength represented by a feed pitch of 1 mm, the amount of residual toner remained on the sieve was measured, and the ratio of flocculation of the toner was calculated using the equation (V) below for evaluation.

Ratio of flocculation of toner(% by mass)={Amount of residual toner(g)/0.5(g)}×100 Equation (V):

The toner with a ratio of flocculation of smaller than 15% by mass was determined as "excellent", the toner with a value of 15% by mass or larger and smaller than 20% by mass was determined as "good", and the toner with a value exceeding 20% by mass was determined as "unacceptable".

Results of evaluation were summarized in Table 4.

TABLE 4

| | | results | | | |
|---|---|---|---|---|---|
| | toner No. | low temperature offset (cold fixability) (° C.) | crease fixability (° C.) | heat-resistant storability (toner aggregation rate) (% by mass) | remarks |
| example 1 | toner 1 | 120 | 115 | 12 | present invention |
| example 2 | toner 2 | 125 | 120 | 10 | present invention |
| example 3 | toner 3 | 135 | 130 | 17 | present invention |
| example 4 | toner 4 | 135 | 135 | 9 | present invention |
| example 5 | toner 5 | 110 | 130 | 11 | present invention |
| example 6 | toner 6 | 120 | 125 | 15 | present invention |
| example 7 | toner 7 | 115 | 115 | 9 | present invention |
| example 8 | toner 8 | 115 | 115 | 17 | present invention |
| example 9 | toner 9 | 110 | 110 | 19 | present invention |
| example 10 | toner 10 | 140 | 135 | 7 | present invention |
| example 11 | toner 11 | 115 | 115 | 13 | present invention |
| example 12 | toner 12 | 120 | 120 | 13 | present invention |
| example 13 | toner 13 | 120 | 120 | 12 | present invention |
| example 14 | toner 14 | 115 | 110 | 12 | present invention |
| comparison 1 | toner 15 | | toner not formed | | comparison |
| comparison 2 | toner 16 | 120 | 145 | 15 | comparison |
| comparison 3 | toner 17 | 155 | 150 | 4 | comparison |
| comparison 4 | toner 18 | 150 | 145 | 6 | comparison |
| comparison 5 | toner 19 | 115 | 115 | 21 | comparison |

As is clear from the results above, toners 1 to 14, representing the electrostatic latent image developing toner of the present invention, were found to show good results in all of cold fixability, crease fixability and heat-resistant storability. On the contrary, comparative toners 15 to 19 were found to be poor in all characteristics. Comparative toner 15 could not even be manufactured since the crystalline resin could not successfully be incorporated into the toner, and therefore could not be evaluated.

What is claimed is:

1. An electrostatic latent image developing toner comprising a toner host particle having a domain-matrix structure, wherein the matrix comprises an amorphous resin that contains a vinyl resin having an acid group, the domain comprises a crystalline resin that is formed by combining a vinyl polymerized segment and a polyester polymerized segment, and a content of the crystalline resin falls within a range from 3 to 30% by mass.

2. The electrostatic latent image developing toner of claim 1, wherein the polyester polymerized segment in the crystalline resin has an ester group concentration M, given by an equation (I) below, within a range from 3.5 to 7.1 (mmol/g):

Ester group concentration $M$ (mmol/g)=[Average amount by mole (mol/mol) of moieties capable of forming ester group contained in polyprotic carboxylic acid and polyhydric alcohol which form 1 mol of polyester polymerized segment]×1000/[(Total molar mass (g/mol) of polyprotic carboxylic acid and polyhydric alcohol)−(Molar mass (g/mol) of water released by dehydration polycondensation)×(Amount by mole of ester group (mol/mol) which forms 1 mol of polyester polymerized segment)] equation (I).

3. The electrostatic latent image developing toner of claim 1, wherein a content of the vinyl polymerized segment in the crystalline resin falls within a range from 5 to 30% by mass.

4. The electrostatic latent image developing toner of claim 1, wherein the toner host particle contains a wax and forms a domain different from that of the crystalline resin.

5. The electrostatic latent image developing toner of claim 1, wherein both of the vinyl resin having an acid group and the vinyl polymerized segment in the crystalline resin contain a resin obtained by polymerizing an acrylic ester monomer represented by a formula (1) below:

$H_2C{=}CH{-}COOR_1$ formula (1)

in the formula (1), $R_1$ represents a $C_{1-8}$ alkyl group.

6. The electrostatic latent image developing toner of claim 1, wherein the toner host particle has a core-shell structure comprising a core particle covered with a shell layer, the core particle having a domain-matrix structure that comprises a matrix containing the amorphous resin and a domain containing the crystalline resin.

7. An electrophotographic image forming method for forming an image through at least charging, exposing, developing, transferring and fixing, wherein the developing is performed by using the electrostatic latent image developing toner of claim 1.

* * * * *